US008101059B2

(12) United States Patent
Jayaraman

(10) Patent No.: US 8,101,059 B2
(45) **Date of Patent: *Jan. 24, 2012**

(54) METHODS OF MAKING TITANIA NANOSTRUCTURES

(75) Inventor: Shrisudersan Jayaraman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 956 days.

This patent is subject to a terminal disclaimer.

(21) Appl. No.: 12/038,847

(22) Filed: Feb. 28, 2008

(65) Prior Publication Data

US 2009/0218234 A1 Sep. 3, 2009

(51) Int. Cl.
*C25B 1/00* (2006.01)
*C25D 9/04* (2006.01)

(52) U.S. Cl. ..... 205/538; 205/322; 205/333

(58) Field of Classification Search ..... 205/538, 205/322

See application file for complete search history.

(56) References Cited

U.S. PATENT DOCUMENTS 2,949,411 A * 8/1960 Beck ..... 205/322
3,892,636 A * 7/1975 Kaneda et al. ..... 205/105
3,917,887 A * 11/1975 Stiller ..... 427/343
6,406,542 B1 * 6/2002 Stepancik ..... 118/635
2005/0103639 A1 * 5/2005 Lu et al. ..... 205/322

OTHER PUBLICATIONS

Chen, X. and S.S. Mao, Titanium dioxide nanomaterials: Synthesis, properties, modifications, and applications. Chemical Reviews, 2007. 107(7): p. 2891-2959.

Daoud, W.A. and G.K.H. Pang, Direct synthesis of nanowires with anatase and $TiO_2$-B structures at near ambient conditions. Journal of Physical Chemistry B, 2006. 110(51): p. 25746-25750.

Mor, G.K., et al., A review on highly ordered, vertically oriented $TiO_2$ nanotube arrays: Fabrication, material properties, and solar energy applications. Solar Energy Materials And Solar Cells, 2006. 90(14): p. 2011-2075.

* cited by examiner

*Primary Examiner* — Harry D Wilkins, III
*Assistant Examiner* — Bryan D. Ripa
(74) *Attorney, Agent, or Firm* — Tina N. Thompson

(57) ABSTRACT

Electrochemical methods for making titanium oxide ($TiO_2$) nanostructures are described. The morphology of the nanostructures can be manipulated by controlling reaction parameters, for example, solution composition, applied voltage, and time. The methods can be used at ambient conditions, for example, room temperature and atmospheric pressure and use moderate electric potentials. The methods are scalable with a high degree of controllability and reproducibility.

17 Claims, 4 Drawing Sheets

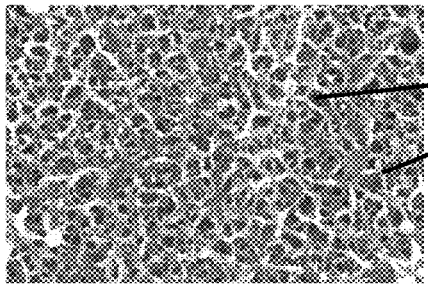
Figure 3a 500 nm
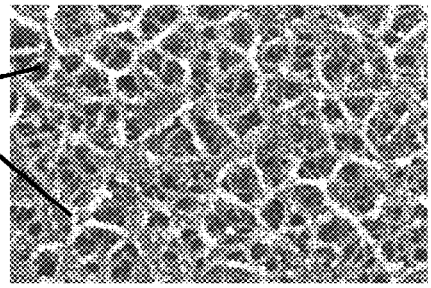
Figure 3b 500 nm
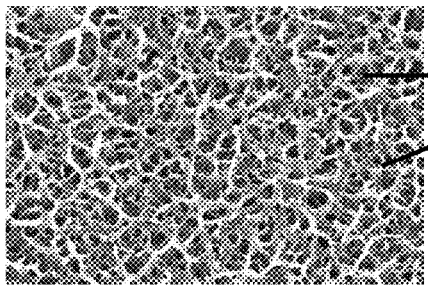
Figure 3c 500 nm
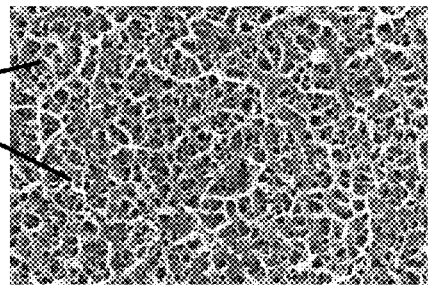
Figure 3d 500 nm
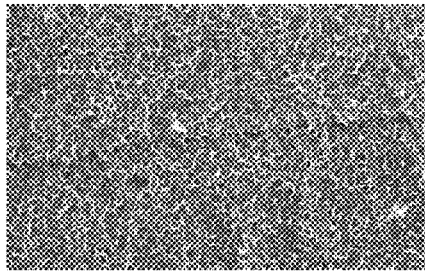
Figure 4a 500 nm
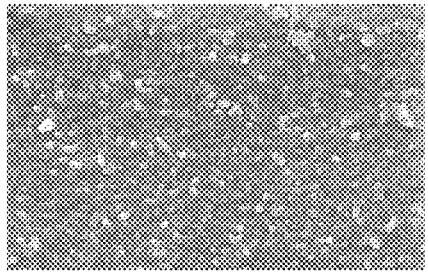
Figure 4b 500 nm
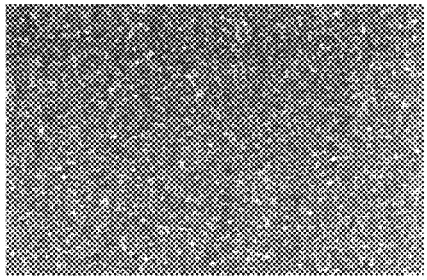
Figure 4c 500 nm
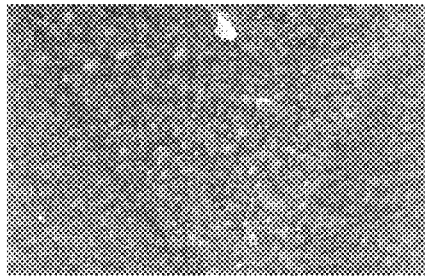
Figure 4d 500 nm

METHODS OF MAKING TITANIA NANOSTRUCTURES

BACKGROUND

1. Field of the Invention

Embodiments of the invention relate to methods of making titania nanostructures and more particularly to electrochemical methods of making titania nanostructures.

2. Technical Background

Metal oxides are material systems explored, in part, due to metal oxides having several practical and industrial applications. For example, titanium (IV) oxide (titania) is used in a wide range of applications such as in paints, cosmetics, catalysis, and bio-implants.

Nanomaterials possess unique properties that are not observed in the bulk material, for example, the optical, mechanical, biochemical and catalytic properties of particles are closely related to the size of the particles. In addition to very high surface area-to-volume ratios, nanomaterials exhibit quantum-mechanical effects which can enable applications that are otherwise impossible using the bulk material. One of the challenges with nanotechnology is the manufacture of nanomaterials in an economically viable process. As a result, only a very few nanotechnology based applications have been commercialized, although a wide spectrum of nanotechnology based applications have been demonstrated on a laboratory scale.

Titania, for example, is a material system where nanotechnology based applications have been demonstrated on a laboratory scale and where the nanomaterials could be used in a wide range of practical applications. Titania nanomaterials can be used, for example, in photovoltaic applications such as dye-sensitized solar cells, metal-semiconductor Junction Schottky Diode solar cells, and doped-$TiO_2$ nanomaterials based solar cells. Titania nanomaterials can be used in photocatalysis, photo-degradation of various organic pollutants, for example, Rhodamine B, Chloroform, Acid Orange II, Phenol, Salicylic Acid, and Chlorophenols. Further, titania nanomaterials are useful in hydrogenation reactions, for example, hydrogenation of propyne ($CH_3CCH$), photocatalytic water splitting. Also, titania nanoparticles can be used in electrochromic devices such as electrochromic windows and displays, in hydrogen storage, in sensing applications, for example, humidity sensing and gas sensing such as in hydrogen, oxygen, carbon monoxide, methanol, and ethanol sensors. Titania nanomaterials can be used in lithium batteries as insertion electrodes.

There are several conventional methods for the synthesis of titania nanomaterials, for example, sol-gel, micelle and inverse micelle, sol, hydrothermal, solvothermal, direct oxidation, chemical vapor deposition, physical vapor deposition, electrodeposition, sonochemical, microwave, organic templated synthesis, aerogel, and $TiO_2$ nanosheets, for example, through delaminated layer synthesis from protonic titanate.

In conventional sol-gel methods, a colloidal suspension or sol is formed from precursors, typically inorganic metal salts or metal-organic compounds, for example, metal alkoxides through hydrolysis and polymerization reactions. Loss of solvent and complete polymerization leads to the transition into a sol-gel phase which is then converted into a dense ceramic through further drying and heat treatment. Typical synthesis of titanium oxide nanomaterials using the sol-gel method includes adding titanium alkoxide (e.g. titanium tetraisopropoxide) precursor to a base such as tetramethyl ammonium hydroxide at 2° C. in alcoholic solvents. This is followed by heating at from 50° C. to 60° C. for 13 days or at from 90° C. to 100° C. for 6 hours and finally subjecting to a secondary treatment involving heating in an autoclave or high-pressure reactor at from 175° C. to 200° C.

Conventional sol-gel methods employ extreme process conditions, for example very low temperature to high temperatures and pressures with high energy requirements, requires high pressure reactors with increased capital costs and uses chemicals, for example, isopropoxides that involve increased handling costs.

In conventional hydrothermal methods, hydrothermal synthesis is performed in an autoclave or high pressure reactor with Teflon 4 liners under controlled temperature and pressure with the reactions occurring in aqueous solutions.

A variation of this method is the solvothermal method wherein organic solvents are used instead of an aqueous environment. Typical synthesis of titanium oxide nanowires involves reacting titanium chloride with an acid or inorganic salt at from 50° C. to 150° C. in an autoclave for 12 hours. This is followed by washing powders of nanomaterial in DI water and ethanol and drying at 60° C. for several hours.

Some of the other conventional hydrothermal methods for making titania nanoparticles are hydrothermal reaction of titanium butoxide (in isopropanol) with water (water:Ti ratio of 150:1) at 70° C. for 1 hour followed by filtration and heat treatment at 240° C. for 2 hours and finally washing in DI water and/or ethanol and drying at 60° C.; hydrothermal reaction of titanium alkoxide precursor in acidic ethanol-water solution at 240° C. for 4 hrs followed by washing and drying; and a method of making $TiO_2$ nanowires through a hydrothermal treatment of $TiO_2$ powder in from 10 molar to 15 molar sodium hydroxide at from 150° C. to 200° C. for from 24 hours to 72 hours followed by washing and drying.

Conventional hydrothermal methods have disadvantages similar to the sol-gel method, for example, high cost autoclaves, use of chemicals that require careful handling, in addition to being time-consuming and having expensive post-processing treatments.

In conventional electrodeposition methods, titania nanowires are deposited using an anodic alumina membrane (AAM) as template. The synthesis is carried out in a titanium chloride solution (at pH=2) using pulsed electrodeposition. The substrate is subsequently heated to 500° C. for 4 hours followed by removal of the AAM template. A prerequisite for this method is the availability of a template that can be removed without leaving any residue using a moderate removal process. Otherwise, regular electrodeposition yields bulk sized particles. Additionally, handling of corrosive electrolyte like titanium chloride in an industrial process can be challenging.

In conventional direct oxidation methods, synthesis of titania nanotubes involves applying a voltage of from 10 volts to 20 volts for from 10 minutes to 30 minutes between two titanium plates in a 0.5% hydrogen fluoride (HF) solution. The use of HF makes this process unattractive for industrial production. Also, the shape of the nanostructures obtained is limited to nanotubes.

Conventional methods of making titania nanostructures are energy intensive, employ expensive capital equipment, for example, high pressure reactors, involve tedious process steps, for example, cleaning, washing and drying of powders, and use nonbenign chemicals, for example, alkoxides, titanium chloride, and HF.

It would be advantageous to have method of making titania nanomaterials in large quantities in an economically viable fashion.

SUMMARY

Methods of making titania nanostructures, as described herein, address one or more of the above-mentioned disadvantages of conventional methods of making titania nanostructures and provide one or more of the following advantages: increased compositional and size control with reduced capital and/or manufacturing costs and, since the nanostructures can be grown directly on substrates, the nanostructures possess an inherently high electrical conductivity. Inherently high electrical conductivity is particularly useful in photovoltaic and photocatalytic applications and can lead to materials and systems with improved architecture.

One embodiment of the invention is a method of making titania nanostructures. The method comprises providing an electrolytic cell, which comprises an anode and cathode disposed in an electrolyte, wherein the anode and cathode each comprise a titanium surface exposed to the electrolyte; and applying an electrical potential to the electrolytic cell for a period of time sufficient to obtain titania nanostructures on the titanium surfaces of the anode and cathode.

Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that both the foregoing general description and the following detailed description are merely exemplary of the invention, and are intended to provide an overview or framework for understanding the nature and character of the invention as it is claimed.

The accompanying drawings are included to provide a further understanding of the invention, and are incorporated in and constitute a part of this specification. The drawings illustrate one or more embodiment(s) of the invention and together with the description serve to explain the principles and operation of the invention.

BRIEF DESCRIPTION OF THE DRAWINGS

The invention can be understood from the following detailed description either alone or together with the accompanying drawing figures.

FIG. 3*a*, FIG. 3*b*, FIG. 3*c*, FIG. 3*d* are SEM micrographs of titania nanostructures made according to one embodiment.

FIG. 4*a*, FIG. 4*b*, FIG. 4*c*, FIG. 4*d* are SEM micrographs of Ti electrodes.

DETAILED DESCRIPTION

Reference will now be made in detail to various embodiments of the invention, examples of which are illustrated in the accompanying drawings. Wherever possible, the same reference numbers will be used throughout the drawings to refer to the same or like parts.

Figure 1:
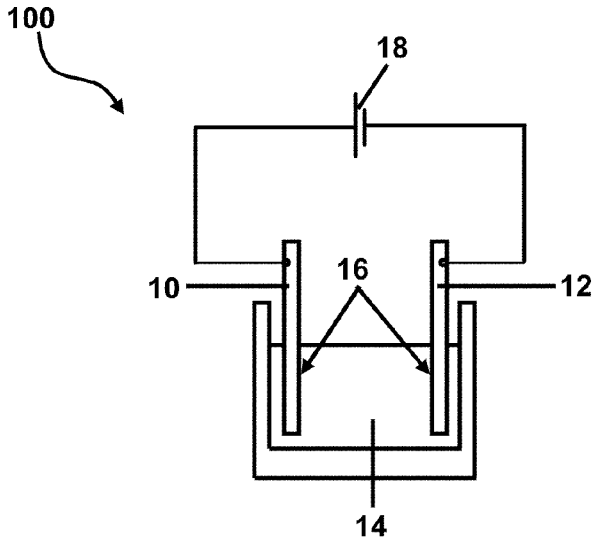
FIG. 1 is an electrolytic cell used in a method according to one embodiment.

One embodiment of the invention is a method of making titania nanostructures. The method comprises providing an electrolytic cell 100, as shown in FIG. 1, which comprises an anode 10 and cathode 12 disposed in an electrolyte 14, wherein the anode and cathode each comprise a titanium surface 16 exposed to the electrolyte; and applying an electrical potential to the electrolytic cell for a period of time sufficient to obtain titania nanostructures on the titanium surfaces of the anode and cathode. The potential can be applied via a power supply 18, for example, a direct current (DC) power supply which can supply a constant voltage or a bipotentiostat, for example, which can supply a cyclic voltage. In one embodiment, the electrolyte is a solution comprising sodium hydroxide, potassium hydroxide, or combinations thereof. The solution, in some embodiments, can be at a concentration of from 3 molar to 8 molar, for example, 5 molar.

In one embodiment, the anode and cathode independently comprise a material selected from titanium metal, titanium foil, titanium film disposed on a conductive support, titanium film disposed on a non-conductive support, and combinations thereof. The conductive support, in some embodiments, comprises a material selected from ITO, copper, and combinations thereof. The conductive support, in some embodiments, is any conductive metallic substrate. The non-conductive support, in some embodiments, comprises a material selected from a polymer, plastic, and combinations thereof. The potential can be 0.6 volts or more, for example, in the range of from 0.6 volts to 5.0 volts. The potential, in some embodiments, is applied continuously for from 30 minutes to 24 hours, for example, for 4 hours to 18 hours. The method can further comprise cleaning the substrates prior to contacting the electrolyte.

The titanium film can be, for example, a thin film or a thick film of Ti metal. The thin film can be, for example, from a few nanometers in thickness to a few microns in thickness. The thick film can be, for example, from tens of microns in thickness to several hundreds of microns in thickness. The electrical conductivity of the Ti surface can facilitate electron transfer at the solid-liquid interface and the electrical connection given to the Ti portion of the substrate. The substrate can be a flat surface or can be a non-flat (flexible) surface.

The method can be used at ambient conditions, for example, room temperature and atmospheric pressure and can utilize low voltage and current, thus, lower energy.

According to one embodiment, the method further comprises cleaning the anode and the cathode after obtaining the titania nanostructures. The cleaning, in some embodiments, comprises acid washing. The acid can be selected from hydrochloric, sulfuric, nitric, and combinations thereof.

EXAMPLES

Annealed, 99.5% titanium substrates available from Alfa Aesar were cut and cleaned by being sonicated in 1:1:1 mixture of acetone, iso-propanol, and water for 15 minutes. The titanium substrates were then rinsed in deionized (DI) water and further sonicated in DI water for 15 minutes. The titanium substrates were dried under a stream of nitrogen.

The electrolyte was prepared using certified ACS sodium hydroxide and certified ACS potassium hydroxide, both available from Alfa Aesar, in DI water.

Electrolytic cells, for example, electrochemical cells of different sizes (1.5"×1"×1" and 3"×1.5"×3.5" internal dimensions) were made using Teflon. Teflon was chosen since Teflon is stable in basic environment as opposed to glass or metal vessels that can be susceptible to etching and/or corrosion effects. Other materials that are resistive to a basic pH can be used to build the electrochemical cells.

A bipotentiostat, model AFRDE5, available from PINE Instrument Company, Grove City, Pa., was used to perform cyclic voltammetry methods. Constant voltage methods were performed using a DC power supply, Model E36319, available from Agilent. In the examples, similarly sized Ti substrates were used as both the anode and as the cathode.

Figure 2A:
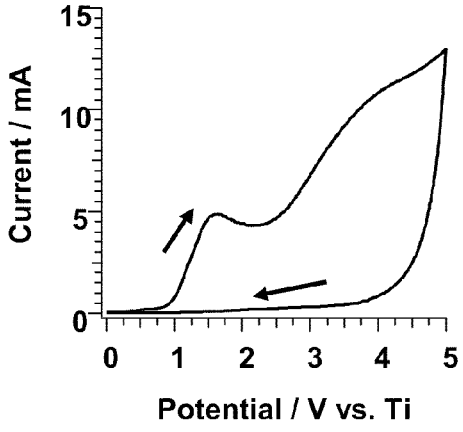
FIG. 2*a* and FIG. 2*b* show the cyclic voltammetry of a Ti substrate.
Figure 2B:
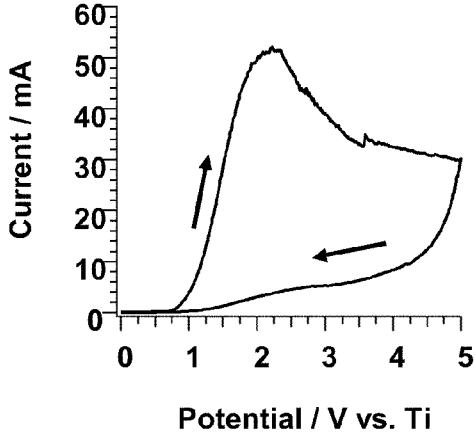

FIG. 2*a* and FIG. 2*b* show the cyclic voltammetry of a Ti substrate in 1 molar (M) NaOH and 1M KOH solutions. As shown in FIG. 2*a*, during the anodic cycle (positive sweep) there are no surface reactions up to a potential of about 0.6 volts (V) (as indicated by zero current). At potentials above 0.6 V, the current increases indicating the onset of oxidation reactions on the surface. As the surface potential is increased, a peak is observed at 1.6 V denoting a diffusion-limited electrochemical reaction.

It can be hypothesized that the reaction is a surface oxidation process that may be limited by the mass transfer of the hydroxyl ions towards the electrode surface. At a potential of 2.3 V, the current increases to further positive values indicating a second electron-transfer reaction. From the trajectory of the current vs. potential curve above 2.3 V, it can be hypothesized that this second electron-transfer reaction is a kinetically controlled oxidation reaction that is not affected by the concentration of hydroxyl ions in the solution (at least at concentrations >1 M). The cyclic voltammetry can be used as a guide for predictive experimentation, i.e. the potential to be applied can be chosen to influence reaction-specific changes to the surface of the anode and/or the cathode.

FIG. 2*b* shows the cyclic voltammetry of a Ti substrate in 1M KOH. The electrochemical behavior of Ti in KOH and the electrochemical behavior of Ti in NaOH electrolytes are different, although the pH of the two solutions is the same. The Ti surface of the substrate is unaffected at potentials below 0.8 V. At potentials above 0.8 V, a diffusion-controlled oxidation reaction up to a potential of 5 V as indicated by a single peak with positive current. Similar to that from the NaOH system, the cyclic voltammetry of Ti in the KOH electrolyte can be used a guide for predictive experimentation to control the surface reactions and eventually surface structure and/or composition.

Pre-cleaned titanium substrates (anodes and cathodes) were placed vertically against the opposing faces of a Teflon cell. The cell was then filled with electrolyte (NaOH or KOH or a combination of both). For the examples conducted in the small cell (1.5"×1"×1"), 15 mL of electrolyte volume was used and for the examples in the larger cell (3"×1.5"×3.5"), 150 mL of electrolyte was used. The substrates were then connected to a DC power supply which applied a preset voltage across the two substrates, now electrodes. The voltage was chosen based on the cyclic voltammetry results previously described. Several examples were performed by systematically changing various experimental conditions. The results are discussed below.

Titanium electrodes (anode and cathode) were subjected to electrochemical control, for example, a constant potential control, in NaOH and KOH solutions. Solution concentrations of 1 M, 5 M and 10 M were tested and it was found that 5 M solutions produced the desired titania nanostructures. No or very little nanostructures were observed on the electrodes that were prepared in 1 M solutions, even at increased times. In 10 M solutions, although surface roughness was observed after electrochemical control, feature sizes were several hundreds of micrometers with little evidence of nanometer sized structures.

Based on the above described results, there is an optimal electrolyte composition range at which $TiO_2$ nanostructures can be formed electrochemically. Henceforth herein, the examples pertain to 5 M solutions of NaOH or KOH or combinations thereof.

Controls corresponding to each electrochemical example were prepared by immersing Ti substrates in the respective electrolyte for the respective time without any applied potential. Electrodes were also subjected to varying time (i.e. the time under electrochemical control). For the electrodes with electrochemical control for 30 minutes and 2 hours, no nanostructures were observed both in NaOH and KOH solutions. Scanning electron microscope (SEM) micrographs of these electrodes (not shown) were similar to those of the controls.

FIG. 3*a*, FIG. 3*b*, FIG. 3*c*, and FIG. 3*d* are SEM micrographs of Ti substrates that were subjected to a constant potential of 5 V for 6 hours in 5 M NaOH solution. FIG. 3*a* and FIG. 3*c* correspond to those of the anode (i.e. the surface experiences a positive potential) and FIG. 3*b* and FIG. 3*d* correspond to those of the cathode (i.e. the surface experiences a negative potential).

FIG. 3*a* and FIG. 3*b* are SEM micrographs of the Ti substrates after being rinsed in DI water and dried under a nitrogen flow following electrochemical processing. The titania nanostructures comprise an open (porous) network 18 connected by short, nanometer sized (width) $TiO_2$ nanowires 20. The "grainy" features are due, in part, to the presence of the leftover NaOH that did not wash out during DI water rinse. This was confirmed by the presence of sodium peaks in X-ray diffraction (XRD) analysis.

FIG. 3*c* and FIG. 3*d* are SEM micrographs of the substrates after being rinsed, acid-washed and dried following electrochemical processing. For the acid-wash step, the substrates were immersed in a mild acid, for example, 1 M HCl, for 30 minutes followed by rinsing in DI water. Well defined titania nanostructures similar to those observed in FIG. 3*a* and FIG. 3*b* are present sans the graininess. This is due, in part, to the complete removal of NaOH by acid-washing. The titania nanostructures comprise an open (porous) network 18 connected by short, nanometer sized (width) $TiO_2$ nanowires 20. This represents a very high surface area surface with very good electrolyte access to the entire surface through open pores.

The sizes of the nanowires in these networks ranged between from 10 nm to 40 nm with an average around 30 nm. These high-surface area structures possess an increased accessibility for liquids or gases to the entire surface area or gases which is an advantageous attribute in applications where material utilization is to be maximized (e.g. photovoltaic cells).

Although the exact mechanism of the creation of these nanostructures is unclear currently, a dissolution-redeposition mechanism can be hypothesized, wherein the electrolyte accesses a maximum $nm^2$ of the surface during the synthesis process. Since the nanostructures are grown into the metal substrate, the nanostructures possess increased electron accessibility and electrical conductivity.

FIG. 4*a*, FIG. 4*b*, FIG. 4*c*, and FIG. 4*d* are SEM micrographs of Ti electrodes that were subjected to a constant potential of 5 V for 6 hours in 5 M KOH solution. FIG. 4*a* and FIG. 4*c* correspond to those of the anode and FIG. 4*b* and FIG. 4*d* correspond to those of the cathode.

FIG. 4*a* and FIG. 4*b* are SEM micrographs of the Ti substrates after being rinsed in DI water and dried under a nitrogen flow following electrochemical processing.

FIG. 4*c* and FIG. 4*d* are SEM micrographs of the substrates after being rinsed, acid-washed and dried following electrochemical processing. For the acid-wash step, the substrates were immersed in a mild acid, for example, 1 M HCl, for 30 minutes followed by rinsing in DI water. No to minimal discernible nanostructures were formed under these conditions. FIG. 4*a* appears to have some structure on the surface, of which disappears after acid wash, as shown in FIG. 4*c*.

Figure 5A:
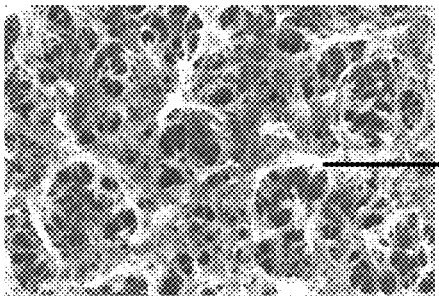
FIG. 5*a*, FIG. 5*b* are SEM micrographs of titania nanostructures made according to one embodiment.
Figure 5B:
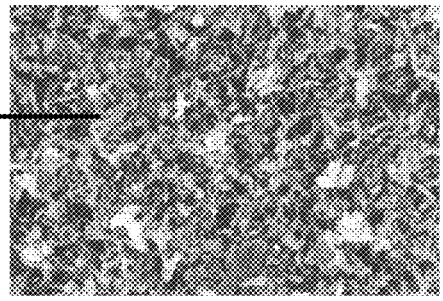

FIG. 5*a* and FIG. 5*b* are SEM micrographs of Ti substrates processed under a constant potential control of 5 V for 16 hours in 5 M NaOH solution. FIG. 5*a* corresponds to the anode and FIG. 5*b* corresponds to the cathode.

As shown in FIG. 5*a*, the surface exhibits webbed titania nanostructures with the connecting titania nanowires 22 having finer sizes as compared to the 6 hour electrode, shown in FIG. 3*a*. The average sizes of the titania nanowires are less than 10 nm and several titania nanowires are bundled together forming a high surface area network. On the other hand, the titania nanostructures 24 on the counter electrode seem to have collapsed, since they are more closed than the corresponding 6 hour electrode, shown in FIG. 3*b*, possibly due to some sort of a coalescence effect. Nevertheless, these disordered structures are still in the sub-100 nm regime.

Figure 6A:
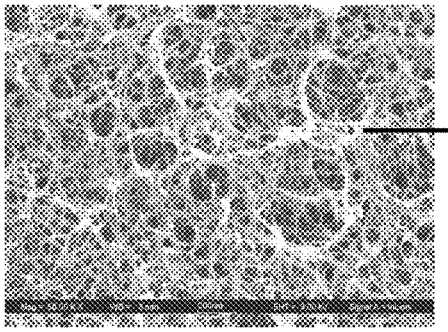
FIG. 6*a*, FIG. 6*b* are SEM micrographs of titania nanostructures made according to one embodiment.
Figure 6B:
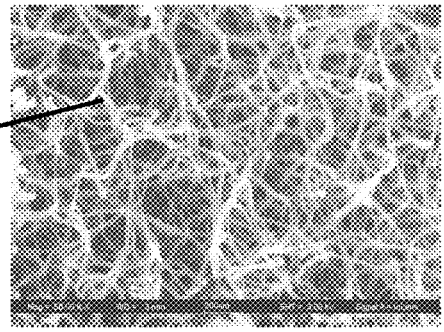

FIG. 6*a* and FIG. 6*b* are SEM micrographs of Ti substrates processed under a constant potential control of 5 V for 16 hours in 5 M KOH solution. FIG. 6*a* corresponds to the anode and FIG. 6*b* corresponds to the cathode.

As compared to the 6 hour electrodes shown in FIG. 4*a* and FIG. 4*b* which did not exhibit titania nanostructures, both the anode and the cathode possess an interwoven network of titania nanostructures 26, for example, titania nanowires. The titania nanowires have high surface area and good accessibility to the titania nanostructures even deep into the substrate. The anode possesses uniform distribution of sub-10 nm sized titania nanowires while the cathode possesses titania nanowires that are predominantly around 30 nm. An advantageous feature of the titania nanostructures is the amount of surface connectivity. The titania nanowires are intricately and inseparably connected to each other to the point where it is almost impossible to identify the start and end of any given strand of titania nanowire.

Also, it is clear that the surface structure of the titania nanostructures can be manipulated by manipulating processing conditions such as electrolyte composition, time, electrode polarity (anode vs. cathode), electrode potential or combinations thereof.

Figure 7A:
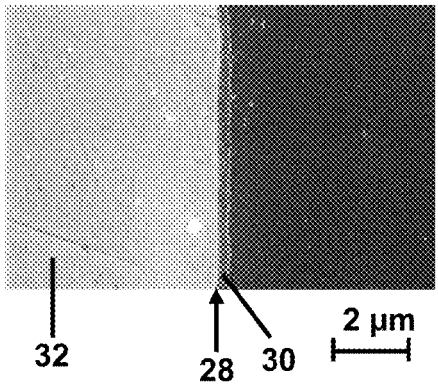
FIG. 7*a*, FIG. 7*b* are cross-sectional SEM micrographs of the embodiment shown in FIG. 5*a*.
Figure 7B:
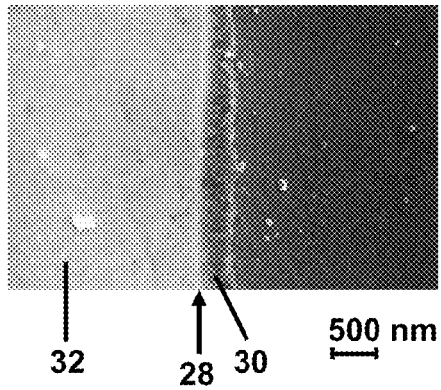
Figure 8A:
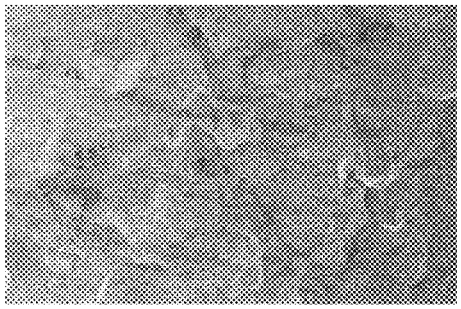
FIG. 8*a*, FIG. 8*b*, FIG. 8*c*, FIG. 8*d* are a series of SEM micrographs at increasing magnifications of the embodiment shown in FIG. 6*a*.
Figure 8B:
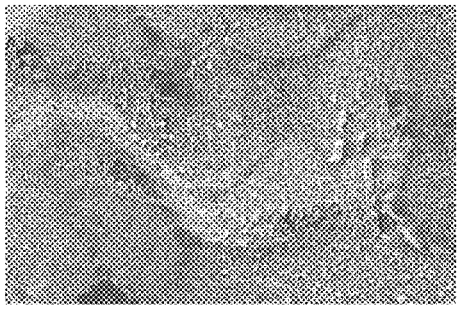
Figure 8C:
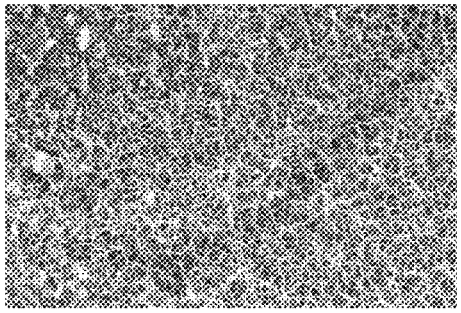
Figure 8D:
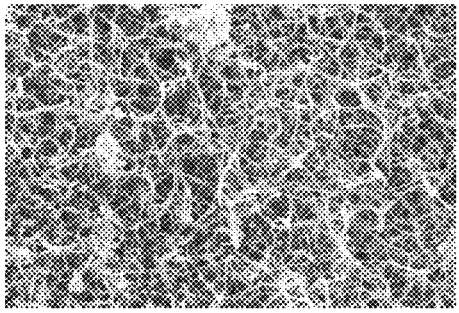

FIG. 7*a* and FIG. 7*b* are cross-sectional SEM micrographs of the 16 hour electrode synthesized in 5 M NaOH (anode) shown in FIG. 5*a*. The titanium to titania interface 28 illustrates a good substrate-to-nanostructure connectivity. The layer of titania nanostructures 30 across the titanium substrate 32 is fairly uniform. The average thickness of the layer of nanostructures is around 500 nm.

The thickness can be controlled, for example, by controlling the time of electrochemical control within the optimum time range, as too little (<6 hours) or too high a time will not yield the desired nanostructures. For example, a 72 hour experiment (Ti under potential control in KOH or NaOH) caused the collapse of nanostructures; this might be due to the mechanical collapse of the nanostructures as Ti surface is continually being subjected to continuous dissolution-redeposition.

Table 1 shows the summary of XRD analysis performed on the Ti electrodes synthesized in 5 M NaOH and 5 M KOH solutions for 16 hours under electrochemical control. The electrodes were subjected to heat-treatment prior to XRD analysis. The heat treatment comprised heating the electrodes to 500° C. at a rate of 10° C. per minute and holding at 500° C. for 1 hour.

TABLE 1

| Electrolyte | Electrode | Phases detected from XRD analysis |
|---|---|---|
| NaOH | Control (no electrochemistry) | Ti metal |
| | Anode | Ti metal |
| | | $TiO_2$ - Rutile |
| | | $TiO_2$ - Anatase |
| | Cathode | Ti metal |
| | | $TiO_2$ - Rutile |
| KOH | Control (no electrochemistry) | Ti metal |
| | Anode | Ti metal |
| | | $TiO_2$ - Rutile |
| | | $TiO_2$ - Anatase |
| | Cathode | Ti metal |
| | | $TiO_2$ - Rutile |

The controls in both the electrolytes did not yield any oxides showing that the surface remained in the metallic state. The anode (working electrode) in both cases showed the presence of metallic Ti and Rutile and Anatase phases of $TiO_2$. The metallic phase is the background from the Ti substrate. The cathode (counter electrode) exhibited the presence of only the Rutile phase of $TiO_2$ in addition to the Ti metal background from the substrate.

This feature could be favorably exploited to selectively synthesize $TiO_2$ nanostructures with a desired phase or phases. The nanostructures remained intact after heat treatment. Also, one could subject these electrodes to further heat treatment to obtain the desired phases.

FIG. 8*a*, FIG. 8*b*, FIG. 8*c*, and FIG. 8*d* are a series of SEM micrographs of the 16 hour anode synthesized in KOH solution taken at increasing magnifications (500×, 2500×, 10,000× and 25,000×) shown in FIG. 6*a*. This electrode was chosen for illustrative purposes only; other electrodes show similar behavior. Moving from FIG. 8*a* through 8*d*, the titania nanostructures are formed uniformly across the entire surface and not merely discrete islands of nanostructures.

This is an advantage of using an electrochemical process where the entire surface can be manipulated uniformly. This has an important implication in terms of scalability and manufacturability of this process. A bigger substrate along with a bigger electrochemical cell can be used to manufacture various quantities (few $mm^2$ to several $m^2$) of $TiO_2$ nanostructures.

In one embodiment, the method comprises making the titania nanostructures in a batch process. In another embodiment, the method comprises making the titania nanostructures in a continuous process.

The process could be a batch process where sheets of Ti or Titanium coated substrates (for example, a Ti film on an indium tin oxide (ITO) or a copper substrate or a Ti film on a polymer substrate such as polyethylene terephthalate (PET)) can be immersed in the electrolyte (NaOH or KOH) and nanostructures created by applying an electric potential.

Another embodiment that could be envisioned is a continuous process wherein two Ti or Ti coated substrate rolls could be continuously fed into a tank containing NaOH or KOH while electric potential is being applied. A downstream cleaning and/or rinsing step could be integrated producing rolls of $TiO_2$ nanostructured surfaces. Also, since the reaction is limited to the surface that is in contact with the electrolyte, excellent process control can be achieved. In both embodiments, the process can be monitored by monitoring the current as a function of time.

It will be apparent to those skilled in the art that various modifications and variations can be made to the present invention without departing from the spirit or scope of the invention. Thus, it is intended that the present invention cover the modifications and variations of this invention provided they come within the scope of the appended claims and their equivalents.

What is claimed is:

1. A method of making titania nanostructures, the method comprising:

providing an electrolytic cell, which comprises an anode and cathode disposed in an electrolyte, wherein the anode and cathode each comprise a titanium surface exposed to the electrolyte; and applying a constant electrical potential to the electrolytic cell for a period of time sufficient to obtain titania nanostructures on the titanium surfaces of the anode and cathode.

2. The method according to claim 1, wherein the electrolyte is a solution comprising sodium hydroxide, potassium hydroxide, or combinations thereof.

3. The method according to claim 2, wherein the solution is at a concentration of from 3 molar to 8 molar.

4. The method according to claim 3, wherein the concentration is 5 molar.

5. The method according to claim 1, wherein the anode and cathode independently comprise a material selected from titanium metal, titanium foil, titanium film disposed on a conductive support, titanium film disposed on a non-conductive support, and combinations thereof.

6. The method according to claim 5, wherein the conductive support comprises a material selected from ITO, copper, and combinations thereof.

7. The method according to claim 5, wherein the non-conductive support comprises a material selected from a polymer, plastic, and combinations thereof.

8. The method according to claim 1, wherein the potential is 0.6 volts or more.

9. The method according to claim 8, wherein the potential is in the range of from 0.6 volts to 5.0 volts.

10. The method according to claim 1, wherein the potential is applied continuously for from 30 minutes to 24 hours.

11. The method according to claim 10, wherein the potential is applied for 4 hours to 18 hours.

12. The method according to claim 1, further comprising cleaning the anode and cathode prior to contacting the electrolyte.

13. The method according to claim 1, further comprising cleaning the anode and the cathode after obtaining the titania nanostructures.

14. The method according to claim 13, wherein the cleaning comprises acid washing.

15. The method according to claim 14, wherein the acid is selected from hydrochloric, sulfuric, nitric, and combinations thereof.

16. The method according to claim 1, which comprises making the titania nanostructures in a batch process.

17. The method according to claim 1, which comprises making the titania nanostructures in a continuous process.

* * * * *